US006112818A

United States Patent [19]

Campbell

[11] Patent Number: 6,112,818

[45] Date of Patent: Sep. 5, 2000

[54] DOWNHOLE SETTING TOOL FOR AN EXPANDABLE TUBING

[75] Inventor: Alasdair Campbell, Ellon, United Kingdom

[73] Assignee: Petroline Wellsystems Limited, Scotland, United Kingdom

[21] Appl. No.: 09/068,352

[22] PCT Filed: Nov. 11, 1996

[86] PCT No.: PCT/GB96/02772

§ 371 Date: May 7, 1998

§ 102(e) Date: May 7, 1998

[87] PCT Pub. No.: WO97/17527

PCT Pub. Date: May 15, 1997

[30] Foreign Application Priority Data

Nov. 9, 1995 [GB] United Kingdom ..... 9522942

[51] Int. Cl.[7] ..... E21B 43/08; E21B 43/10

[52] U.S. Cl. ..... 166/384; 166/207; 166/242.1

[58] Field of Search ..... 166/384, 207, 166/381, 277, 242.1, 243

[56] References Cited

U.S. PATENT DOCUMENTS

| | | | |
|---|---|---|---|
| 3,191,677 | 6/1965 | Kinley | 166/277 |
| 3,353,599 | 11/1967 | Swift . | |
| 3,358,760 | 12/1967 | Blagg . | |
| 3,691,624 | 9/1972 | Kinley | 29/523 |
| 3,776,307 | 12/1973 | Young . | |
| 3,785,193 | 1/1974 | Kinley et al. | 72/393 |
| 3,948,321 | 4/1976 | Owen et al. . | |
| 4,289,200 | 9/1981 | Fisher, Jr. . | |
| 5,048,611 | 9/1991 | Cochran | 166/374 |
| 5,415,441 | 5/1995 | Kilgore et al. | 285/322 |

FOREIGN PATENT DOCUMENTS

| | | |
|---|---|---|
| 93/25800 | 12/1993 | WIPO . |

*Primary Examiner*—George Suchfield
*Attorney, Agent, or Firm*—Alston & Bird LLP

[57] ABSTRACT

A downhole running and expansion tool for mounting on a string in combination with a length of expandable tubing, the tool including a mounting portion defining a ratchet thread for engaging a corresponding thread defined by the expandable tubing, the thread preventing axial separation of the tool and tubing and releasably restraining the tool against axial movement into the tubing. Releasable retainers, such as shear pins may also be provided between the tool and tubing. On reaching the desired location in a bore, a combination of downwards jars and weight release the shear pins and moves the tool thread past the tubing thread. The tool includes an expander cone which is pushed through the tubing to expand the tubing to the desired diameter.

14 Claims, 1 Drawing Sheet

DOWNHOLE SETTING TOOL FOR AN EXPANDABLE TUBING

This invention relates to a downhole tool, and in particular to a tool for use in running in and then expanding a length of expandable tubing.

WO-A-93\25800 (Shell Internationale Research) discloses a method of completing an uncased section of a borehole in an underground formation. A liner provided with overlapping longitudinal slots is fixed at a predetermined position in the borehole. A tapered expansion mandrel having a maximum diameter which is of larger diameter than the liner is moved through the liner and expands the liner to a diameter larger than the mandrel maximum diameter. Ideally, the liner is expanded to such an extent that it contacts the bore wall.

It is among the objects of at least one embodiment of the present invention to provide a tool which may be utilised to run a length of slotted liner into a bore, release the liner and then expand the liner.

According to present invention there is provided a downhole tool for mounting on a string and for use in running in and expanding a length of expandable tubing, the tool comprising: an expandable tubing mounting portion including means for supporting a length of expandable tubing depending from the tool and preventing axial separation of the tool and tubing and means for releasably restraining the tool against axial movement into the tubing; and a tubing expanding portion including means for expanding the tubing on movement of said expanding portion through the tubing.

In use, the tubing supporting means may be arranged to support securely a desired length and weight of tubing on the tool and thus minimise the possibility of inadvertent release of the tubing as the tool is run into the bore. However, the releasable restraining means is desirably arranged such that movement of the tool into a length of fixed tubing may be initiated by a relatively small downward force. The present invention thus provides a means of satisfying these somewhat conflicting requirements.

Preferably, the tool is provided in combination with a length of expandable tubing, most preferably a length of expandable slotted tubing (EST).

Preferably also, the tubing supporting means includes a ratchet arrangement, conveniently a ratchet thread, which will allow downwards movement of the tool relative to the fixed tubing on application of a predetermined downward force, such that the ratchet arrangement may also provide the releasable restraining means. However, in the preferred tool a separate releasable restraining means is provided in the form of one or more releasable connections, such as shear pins, a shear ring, spring latch or any suitable releasable retainer as known to those of skill in the art. This minimises the possibility of the tool being inadvertently or accidentally pushed into the tubing while running in on, for example, the tubing encountering a blockage in the bore during running in.

Preferably also, the tubing expanding portion includes secondary tubing expanding means to guarantee a minimum diameter of expanded tubing. Most preferably, the secondary tubing expanding means includes two axially spaced rings defining alternating fluid bypass channels in the outer diameter thereof.

Preferably also, the tubing expanding means defines a cone including one or more axial bypass ports, to prevent fluid surges during expansion and retrieval operations.

Preferably also, the tool includes a leading portion having an external diameter corresponding to the inner diameter of the tubing. The leading portion thus provides lateral support for the tubing as it is run in and provides centralisation of the tool in the tubing during expansion.

The invention also relates to a method of running and expanding a length of expandable tubing.

According to a further aspect of the present invention there is provided a downhole tool for mounting on a string in combination with a length of expandable tubing, the tool including an expandable tubing mounting portion defining a ratchet thread for engaging a corresponding thread defined by the expandable tubing, the thread preventing axial separation of the tool and tubing and releasably restraining the tool against axial movement into the tubing, and the tool further including an expander cone.

These and other aspects of the invention will now be described, by way of example, with reference to the accompanying drawings, in which.

Figure 1:
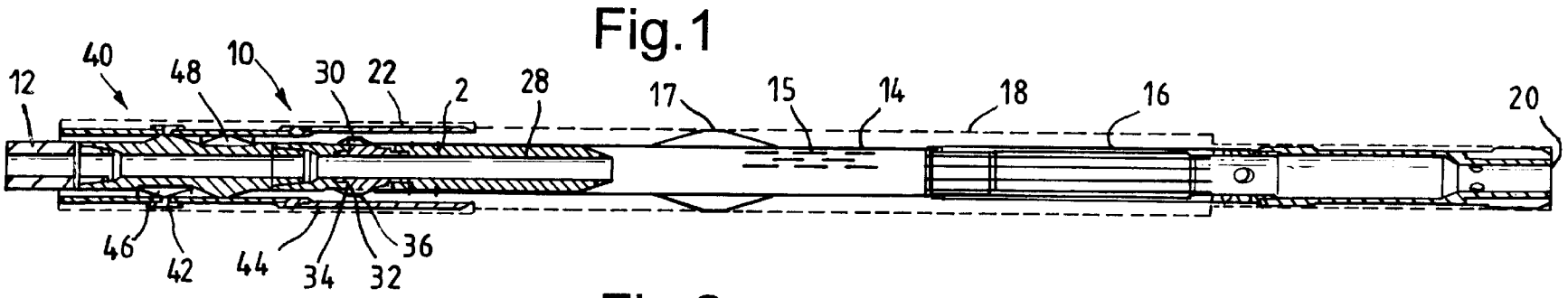
FIG. 1 is a sectional view of a tool in accordance with a preferred embodiment of the present invention, shown together with a length of expandable slotted tubing (EST) in the bottom of a bore, prior to release and expansion of the tubing.

Reference is first made to FIG. 1, which illustrates a running and expansion tool 10 in accordance with a preferred embodiment of the present invention shown located in the lower portion of a bores. The tool is mounted on the lower end of a drill pipe string 12 and supports a length of expandable slotted tubing (EST) 14 slots 15 being shown in FIGS. 1 and 2 of the drawings and an expandable bottom sub 16. Those of skill in the art will appreciate that only a short length of EST is shown on the drawings; in practice, a longer length of tubing will be supported by the tool, the tubing being formed of a number of connected EST sections. Centralisers 17 are provided on the tubing 14 to facilitate smooth running in and to correctly locate the tubing 14 in the bore. The centralisers 17 are collapsed on expansion of the tubing 14, as will be described. The tool 10 is illustrated at the lower end of a bore 18, with the sub 16 engaging the bore bottom 20. The upper end of the tubing 14 is located within the end of the existing casing or liner 22, with the remainder of the tubing 14 located in an uncased section of the bore.

Figure 2:
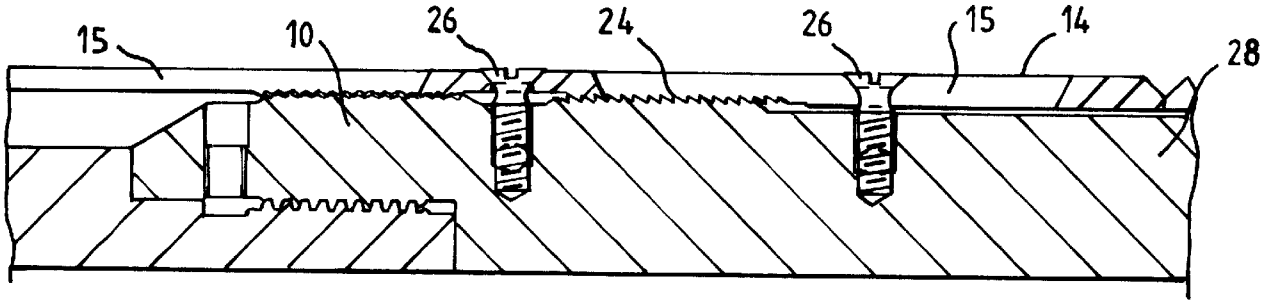
FIG. 2 is an enlarged sectional view of area 2 of FIG. 1.

The tubing 14 is mounted on the tool 10 by a ratchet thread 24 and a number of shear screw 26, as illustrated more clearly in FIG. 2 of the drawings. The thread 24 supports the weight of the tubing 14, and the sub 16 and the tubing 14 is therefore most unlikely to become inadvertently detached from the tool by the shocks and jars experienced by the string as it is run into the hole. Application of a predetermined downward force to the tool 10 against an axially fixed tubing 14 will however cause the inner threads to ride under the outer threads. The shear screws 26 are intended to prevent the tool 10 moving into the tubing 14 during run in. However, application of a predetermined axial force, for example, by jarring down or applying weight to the string, will shear the screws 26 and permit the tool 10 to be moved through the tubing 14. The number (up to forty) and specification of the shear screws 26 may be chosen to provide a variable "set down" rating.

The thread 24 and shear screws 26 are provided on the upper portion of a nose cone 28 which extends into the tubing 14, providing additional lateral support for the tubing 14 on running in, and serving to centralise the tool 10 in the tubing 14 during expansion, as will be described.

Directly above the nose cone 28, and above the upper end of the tubing 14, the tool 10 provides an expansion cone 30 comprising a hardened outer ring 32 trapped between two halves 34, 36 and defining various axial bypass ports to prevent fluid surges during expansion and retrieval. In other embodiments the bypass ports may be formed by providing milled slots in either side of the cone in communication an annular passage defined between the cone and an inner sleeve. Upwardly of the cone 30 is a back-up cone 40 comprising two axially spaced rings 42, 44 with alternate sections 46, 48 milled out to provide for fluid bypass.

Figure 3:
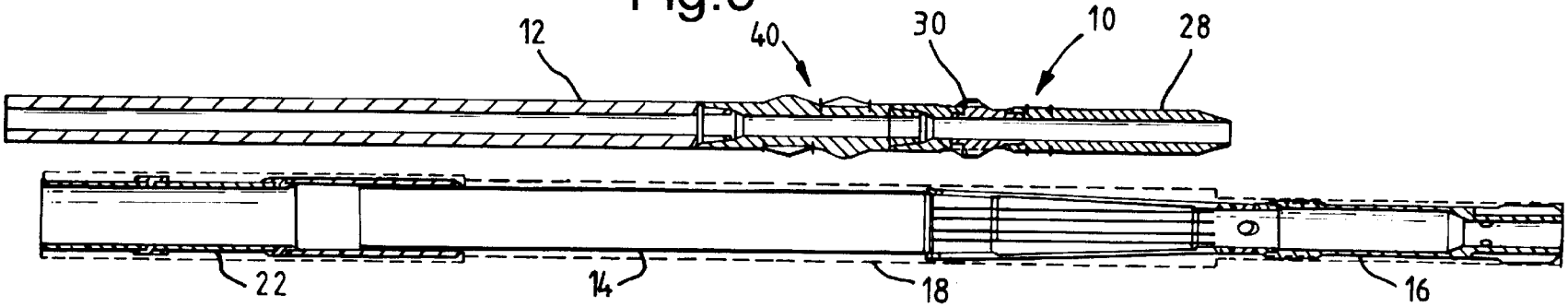
FIG. 3 is a sectional view of the tool and tubing of FIG. 1 following release and expansion of the tubing, but showing the tool and tubing on spaced parallel axes.

In use, the tubing 14 and sub 16 are mounted to the tool 10 and drill pipe as described above. The string is then run in until the sub 16 engages the bore bottom. Jarring down on the string shears the screws 26 and application of weight on the string then pushes the tool 10 into the tubing 14. As the expansion cone 30 moves into the upper end of the tubing 14, the tubing is deformed radially outwardly, and as the cone 30 moves through the tubing 14 it assumes an expanded diameter greater than the outer diameter of the cone 30. The back-up cone 40 follows the cone 30 through the tubing 14 and ensures that the expanded tubing 14 is at least of a predetermined minimum diameter. The tool 10 is moved downwardly through the tubing 14 until the expansion cone 30 enters the upper end of the bottom sub 16, the relative axial positions of the tool 10 and tubing 14 at this stage being illustrated in FIG. 3 of the drawings. The tool 10 is then retrieved from the bore, leaving the expanded tubing 14 in place.

It will be clear to those of skill in the art that the above-described embodiment is merely exemplary of the present invention, and that various modifications and improvements may be made thereto without departing from the scope of the invention.

What is claimed is:

1. Downhole apparatus comprising a length of expandable cylindrical tubing and a tool for mounting on a string and for running in and expanding said length of expandable tubing, the tool comprising: a tubing mounting portion for location at a first end of said length of expandable tubing such that said length of expandable tubing may depend from the tool, the mounting portion comprising means for supporting the tubing and preventing axial separation of the tool and tubing and means for releasably restraining the tool against axial movement into the tubing; and a tubing expanding portion for location at the first end of the tubing and including means for expanding the tubing on said expanding portion being pushed through the tubing.

2. The apparatus of claim 1, wherein said length of tubing defines overlapping longitudinal slots.

3. The apparatus of claim 1, wherein the tubing supporting means includes a ratchet arrangement for engaging the tubing.

4. The apparatus of claim 3, wherein the ratchet arrangement is in the form of a ratchet thread.

5. The apparatus of claim 1, wherein the releasable restraining means is in the form of one or more releasable connections.

6. The apparatus of claim 5, wherein the one or more releasable connections are in the form of one or more shear screws.

7. The apparatus of claim 1 wherein the tubing expanding portion includes a secondary tubing expanding means for guaranteeing a minimum diameter of expanded tubing.

8. A downhole tool for mounting on a string and for use in running in and expanding a length of expandable tubing suspended from the tool, the tool comprising: a tubing mounting portion for location at a first end of a length of expandable tubing depending from the tool, the mounting portion comprising means for supporting the tubing and preventing axial separation of the tool and tubing and means for releasably restraining the tool against axial movement into the tubing; and a tubing expanding portion for location at the first end of the tubing and including means for expanding the tubing on said expanding portion being pushed through the tubing, the tubing expanding portion including a secondary tubing expanding means for guaranteeing a minimum diameter of expanded tubing and wherein the secondary tubing expanding means includes two axially spaced rings defining alternating fluid bypass channels in the outer diameter thereof.

9. The apparatus of claim 1, wherein the tubing expanding means defines a cone and one or more axial bypass ports.

10. The apparatus of claim 1, wherein the tool includes a leading portion having an external diameter corresponding to an inner diameter of the tubing.

11. The apparatus of claim 10, wherein the releasable restraining means is in the form of one or more shear connections between the tool leading portion and the tubing.

12. A downhole tool for mounting on a string in combination with a length of expandable tubing, the tool including an expandable tubing mounting portion defining a ratchet thread for engaging a corresponding thread defined by the expandable tubing, the thread preventing axial separation of the tool and tubing, through relative axial movement of the tool and tubing in one direction, and releasably restraining the tool against axial movement into the tubing, through relative axial movement of the tool and tubing in an opposite direction, and the tool further including an expander cone.

13. The tool of claim 12, wherein the tool includes a leading portion having an external diameter corresponding to the inner diameter of the tubing and shear screws are provided between said leading portion and the tubing.

14. A method of running a length of expandable tubing into a bore and expanding the tubing therein, the method comprising the steps of:

providing a running and expanding tool;

mounting the tool on a string;

suspending a length of expandable cylindrical tubing from the tool, the tool supporting the tubing and preventing axial separation of the tool and tubing, and releasably restraining the tool against axial movement into the tubing;

running the tool and tubing into a bore on said string and locating the tubing at a desired position in the bore; and pushing the tool, via said string, into the tubing and expanding the tubing.

* * * * *